United States Patent [19]

Ahrens

[11] 4,387,520

[45] Jun. 14, 1983

[54] SIGN HOLDER

[76] Inventor: James E. Ahrens, 435 N. Old Ranch Rd., Arcadia, Calif. 91006

[21] Appl. No.: 222,599

[22] Filed: Jan. 5, 1981

[51] Int. Cl.[3] ..... G09F 3/18; G09F 1/10; G09F 7/02; A47F 7/14

[52] U.S. Cl. ..... 40/16.6; 40/124.4; 40/611; 40/606; 40/490; 52/823; 52/38; 52/716; 248/473; 248/466; 273/148 A

[58] Field of Search ..... 40/606, 610, 592, 16.4, 40/10 R, 16, 609, 618, 611, 616, 11 R, 622, 16.6, 17, 10 D, 18, 20 R, 23 R, 124.4, 124, 124.2, 490, 491; 248/466, 468, 473, 580, 611, 613; 52/36, 38, 716, 823; 273/148 A, 150, 151, 269; 46/31; 294/6, 27 R

[56] References Cited

U.S. PATENT DOCUMENTS

| | | | |
|---|---|---|---|
| 1,768,675 | 7/1930 | Egan | 40/124.1 |
| 1,967,780 | 7/1934 | Pollack | 273/150 |
| 2,520,490 | 8/1950 | Boward | 40/124.4 |
| 2,538,056 | 1/1951 | Staaf | 273/150 |
| 2,729,452 | 1/1956 | Baumann | 40/10 R |
| 2,785,901 | 3/1957 | McElmore | 40/16 |
| 2,810,460 | 10/1957 | Winnan | 52/823 |
| 2,920,407 | 1/1960 | Stathem | 40/10 R |
| 2,928,201 | 3/1960 | Shanok et al. | 52/716 |
| 3,312,034 | 4/1967 | Steinmann | 52/38 |
| 3,525,493 | 8/1970 | Chrietzberg et al. | 40/606 |
| 3,736,682 | 6/1973 | Farmer et al. | 40/10 R |
| 3,757,443 | 9/1973 | Miller et al. | 40/594 |
| 3,787,922 | 1/1974 | Foy et al. | 248/466 |
| 4,105,814 | 8/1978 | Eggert | 52/716 |
| 4,291,882 | 9/1981 | Del Monte | 40/124 |

*Primary Examiner*—Gene Mancene
*Assistant Examiner*—Michael J. Foycik
*Attorney, Agent, or Firm*—Christie, Parker & Hale

[57] ABSTRACT

A holder for holding thin rigid planar signs includes a base having a trough for receiving and seating an edge of the sign. An essentially planar wall extends from the trough against which the sign is urged by a pressure pad in order to maintain the sign in a stationary position. The pressure pad is mounted in the base and has a plurality of blades projecting essentially normal to and abutting the surface of the planar wall. Upon insertion of the sign in the holders, the blades exert a resulting force on the sign to urge the sign flush against the planar wall. By virtue of the seating of the sign edge in the trough, the sign is prevented from rotation away from the wall and out of the holder as a result of wind forces acting on the sign.

12 Claims, 7 Drawing Figures

Fig. 1
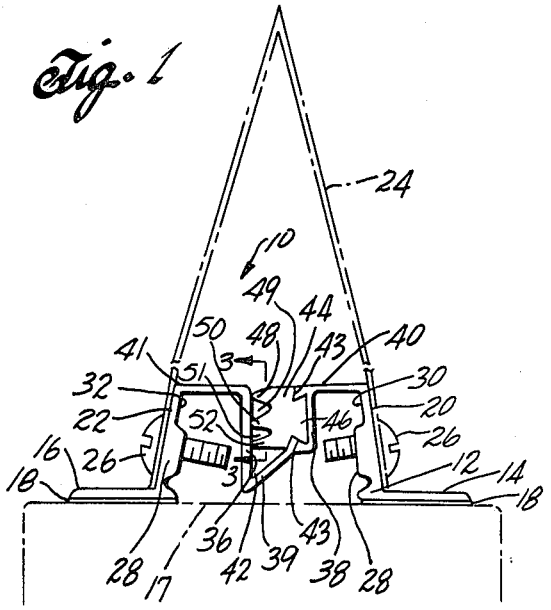
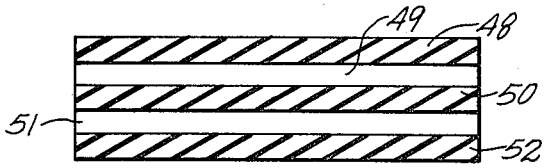
Fig. 3
Fig. 2A
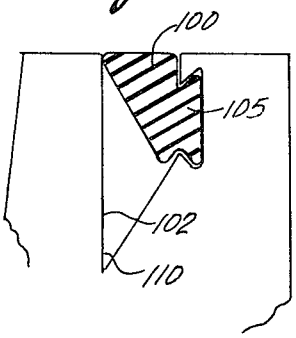
Fig. 2B
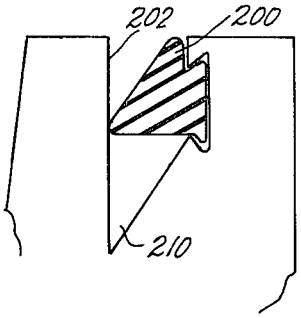
Fig. 2C
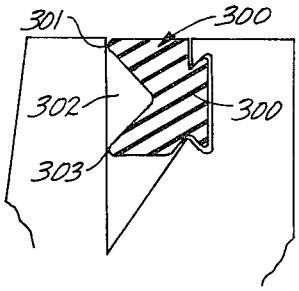

SIGN HOLDER

BACKGROUND OF THE INVENTION

1. Field of the Invention

This invention relates to sign holders, and more specifically, to a sign holder allowing for rapid insertion and removal of signs formed from thin, planar sheet material.

2. Description of the Prior Art

Signs and sign holders are old in the art. Several holders have been proposed for holding thin signs. Miller, for example, in U.S. Pat. No. 3,757,443 describes a sign having two facing rectangular boards that abut at their tips and ends, but are bowed apart at the midpoint of their bottoms. A short block is connected to the bottoms of the respective panels at a midpoint of the panels, such panels being secured to the block by means of locking screws. The block includes a groove for receiving a single card-type sign that is anchored by means of the locking screws. However, Miller discloses that such a sign does not have the wind resistance of the two-panel sign and would be useful primarily for indoor applications.

Another device is described by Hubbell in U.S. Pat. No. 2,530,821. Hubbell discloses a bulletin sheet holder support in which the sheet is hung from its upper end. This device has first and second interconnected flanges arranged in a general U-shape which is downward facing, the first flange for mounting on a flat vertical wall surface. A flexible blade extends from the extremity of the second flange across the holder and contacts the first flange. Sheet material to be held by the holder is slipped up between the blade and the first flange. After insertion the weight of the material, when released, will draw the blade downward setting up a binding action between the blade, the flange and the sheet material. The structure of the holder described by Hubbell does not solve the problem addressed by applicant since the holder is utilized in indoor applications, the sheet in the holder lies against a flat vertical wall and the sheet is hung from the top. Thus, the sheet would be incapable of rotating away from the wall not due to the constructional features of the holder, but by virtue of the sheet's abutment with the wall. Additionally, securement of the sheet in the holder relies upon the downward pull of the material on the blade.

Yet another commercially-available holding device has a vertical wall portion having a pair of single leaf pressure-applying springs in contact with the lower portion of the wall. A sign is held between the wall and the springs. Upon insertion of a sign in the holder, the springs urge the sign against the flat wall for the purpose of securing the sign in the holder. The holder, however, suffers from inability to withstand the force of winds on the sign, since the sign in response to such winds is capable of rotating about the springs and out of the holder. Additionally, in order for the springs to apply sufficient pressure on the sign against the wall at the lower portion of the wall, the spring must be relatively stiff. Consequently, the device is characterized in that the sign may be readily inserted but fairly difficult to remove.

The present invention overcomes the aforementioned deficiencies.

SUMMARY OF THE INVENTION

Briefly, an embodiment of the present invention is a holder for holding a thin planar panel. The holder has a base and a trough or groove defined within the base. The trough is adapted for receiving an edge of the sign and for locating the sign in the holder. An essentially planar wall extends from the trough. Resilient blade means are mounted in the base and are oriented for urging a sign inserted in the holder against the wall. The trough restrains the edge of the sign so that the sign is prevented from rotation away from the wall.

As a feature of the invention, the resilient blade means comprises a base portion and a plurality of blades extending from the base portion. Each blade lies in a plane substantially normal to the wall, and each blade has a tip that terminates adjacent the surface of the wall. Preferably, the blade means includes three blades.

Preferably, the blade means is formed of semi-rigid resilient material such as rubber. The three blades defining the resilient finger means provide ease of insertion and removal of the sign from the holder, while urging the sign against the planar wall through three pressure points.

As a feature of the invention and by virtue of the seating of the edge of the sign in the trough, the sign is prevented from rotation out of the holder under the action and influence of strong winds.

BRIEF DESCRIPTION OF THE DRAWINGS

FIG. 1 is a side elevation view in cross section of a holder embodying the present invention in which a triangular-shaped sign is shown in phantom;

FIGS. 2A and 2B are partial side elevation views of pressure pad arrangements having a single point of contact with a sign inserted in the holder of FIG. 1;

FIG. 2C is a partial side elevation view of a pressure pad arrangement having two points of contact with a sign inserted in the holder of FIG. 1;

FIG. 3 is a partial cross-sectional view along line 3—3 of FIG. 1.

DETAILED DESCRIPTION

Figure 4:
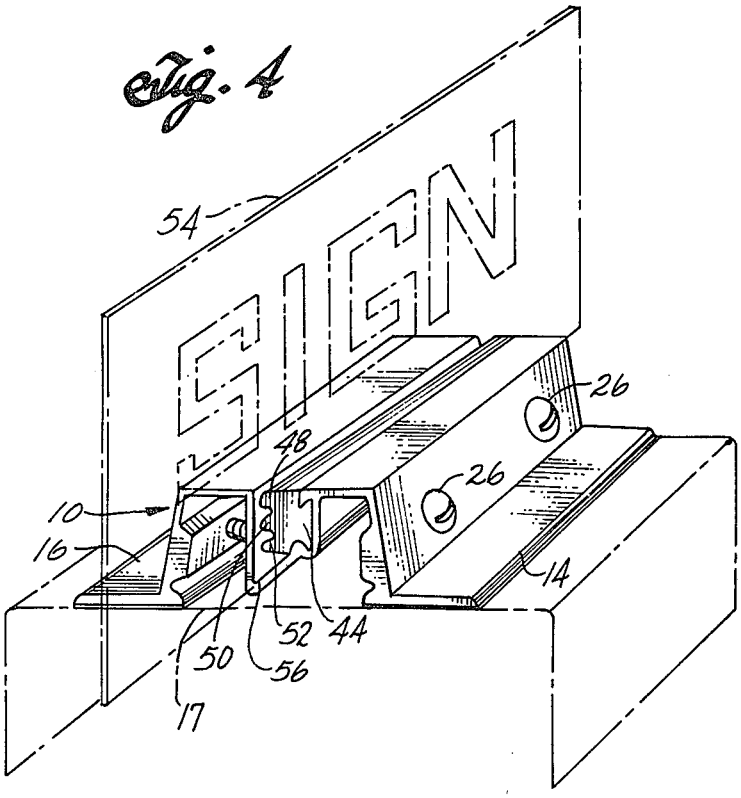
FIG. 4 is a perspective view of the holder of FIG. 1 in which a thin, rigid, planar sign inserted in the holder is shown in phantom.

Referring to FIG. 1, there is shown in cross section the holder 10 according to the present invention. The holder 10 comprises a base 12 formed preferably of rigid material such as, for example, extruded aluminum, mounting screws 26 and pressure member or pad 44. The base 12 includes a pair of essentially flat flange-type extensions 14 and 16 that form a pedestal for mounting upon a base support surface 17. For example, in a conventional automobile service station, the base support surface 17 may be the top of a gasoline pump to which the holder is mounted for purposes of displaying the fuel cost.

Attached to the lower surfaces (as viewed in FIG. 1) of extensions 14 and 16 is a pressure-sensitive adhesive strip 18 disposed along the lower surfaces of the extensions. The adhesive may be any one of a number of commercially-available adhesives known to those in the art. The lower surface of the adhesive 18 may be covered with a release liner removable just prior to installation of the holder. Removal of the release liner exposes the lower surface of the adhesive in preparation for attaching the holder to a support surface. Although the holder of FIG. 1 is shown in a horizontally mounted position, it is to be understood that the holder may be installed in any orientation such as on the side of a support surface or on a ceiling structure to provide a downward hanging sign capability.

The holder includes a pair of symmetrical and inclined sides 20 and 22 that extend upward from extensions 14 and 16 respectively. The sides 20 and 22 lay along the lower sides of an isosceles triangle to provide a mounting surface for signs having triangular cross sections. Such a triangular-shaped sign 24 is shown in phantom in FIG. 1. The sign 24 is secured to respective holder sides 20 and 22 by means of mounting screws 26. A mounting screw 26 extends through respective sides 20 and 22 and through raised land portions 28 located on the interior surfaces 30 and 32 of sides 20 and 22 respectively. The raised land portions 28 provide a greater amount of screw thread area for the screws 26 than is available in sides 20 and 22. Thus, the raised land portion 28 provides for enhanced structural rigidity for mounting a triangular-shaped sign.

To be explained in more detail, the holder 10 has an essentially planar wall 36 and a pressure pad mounting wall 38. The walls 36 and 38 are interconnected to the holder side walls 20 and 22 by means of horizontal ribs 40 and 41 respectively. Wall 38 is substantially parallel to wall 36 and has a lower inclined wall portion 39. Wall 38 forms a backing for pressure pad 44 and is in fixed relation to wall 36.

The juncture of walls 36 and 39 at the lower extremities thereof form a V-shaped trough or groove 42. The trough 42 extends for the length of the base 12 and as will be explained receives the lower portion of a single planar sheet sign inserted in the holder.

Figure 2:
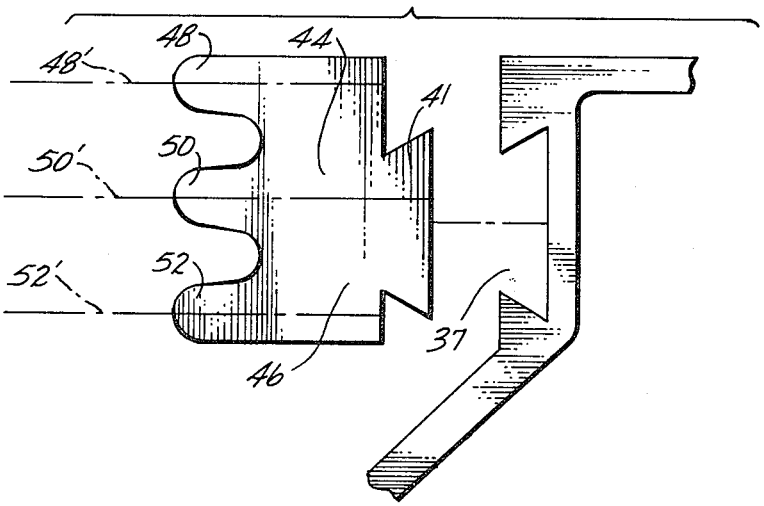
FIG. 2 is an exploded partial side elevation view of the pressure pad and supporting wall of the holder of FIG. 1.

Extending from wall 38 is a pressure pad 44 formed of semi-rigid yet resilient material such as rubber. The pressure pad 44 is mounted at its base region 46 in a dovetail arrangement to wall 38. The mortise 37 of wall 38 and tenon 41 of the base region 46 that form such dovetail arrangement is shown in FIG. 1 at 43 and in a partial exploded view in FIG. 2.

The pressure pad 44 includes 3 projecting spaced apart blades 48, 50 and 52. The blades 48, 50 and 52 have a centerline 48', 50' and 52' respectively that is orthogonal to wall 36. The blades extend longitudinally for the length of the holder (see FIG. 4) and are arranged, as viewed in FIG. 4, in a vertically spaced apart relation. Consequently, as a sign is inserted into the holder, the sign first contacts blade 48 then blade 50 and finally blade 52.

Although the extremities of the blades may be located in the region of the surface of wall 36, in the preferred embodiment the blades are sized such that the extremities thereof are adjacent and therefore just contact the surface of wall 36. Due to the resilient nature of the blade material, the blades are capable of bending in response to insertion of a sign in the holder.

It has been found that pressure pads having single and double blades do not provide the ease of insertion and removal of a sign from the holder as does the three-blade arrangement described herein.

A single-blade arrangement, as shown in FIG. 2A, provides a holder in which insertion of a sign is difficult since the blade material between the point of contact between the blade 100 and the dovetail mounting arrangement 105 is being compressed rather than bent as the sign is being inserted into the holder. Due to the amount of pad material, the pad does not readily "yield" under insertion forces and thus the holder's utility suffers because of the difficulty in inserting a sign therein.

Additionally, due to the amount of pad material and general triangular shape of the pad, the sign is wedged in a ratchet like manner against wall 102 with increasing force as the sign is inserted into the holder. Thus, as the sign is urged into the holder, resistance to insertion of the sign into the holder increases.

Removal of the sign, however, does not present the problems just described. Namely, removal of the sign causes the pad to be drawn in a direction away from the wall 102 so that upon initial movement of the sign out of the holder the force urging the sign against the wall 102 is reduced. The reduced force acting on the sign provides for easier sign removal relative to sign insertion.

FIG. 2B shows a pressure pad 200 having the pad 100 of FIG. 2A inverted so that the point of contact of the pad 200 with the wall 202 is in the vicinity of the trough 210. The comments concerning the device shown in FIG. 2A are equally applicable here, however, in a reverse sense in that the device of FIG. 2B provides for ease of insertion of a sign and relative difficulty in removal.

Additionally, since the point of contact of the pad 200 with the wall 202 is in the vicinity of the trough 210, the sign may rotate out of the holder (in a clockwise direction as viewed in FIG. 2B) under the influence of corresponding forces created by wind and the like.

The device of FIG. 2C shows a pad having upper and lower points of contact with wall 302 at 301 and 303 respectively. The pad, however, provides the problems that characterize the devices shown in FIGS. 2A and 2B. Namely, a sign is difficult to insert due to upper contact 301 and as described for the device of FIG. 2A, and difficult to remove due to lower contact 303, as described for the device of FIG. 2B.

Advantageously, the blades 48, 50 and 52 (as shown in FIG. 1) extends as thin fingers from the pressure pad 44 and contact the wall 36 for the length of the pad. As shown in FIG. 1, the blades are arranged in a periodic fashion such that adjacent blades are spaced vertically and equally apart. The spaces between the blades and shown at 49 and 51 are of similar and complementary cross section. The cross section of the blades and spaces as shown in FIG. 1 are sinusoidal in nature, however, it is to be understood by those skilled in the art that other cross-sectional shapes such as triangular are contemplated to be within the scope of the invention.

By virtue of the space between the blades and since the pad material comprising the blades acts in bending rather than in compression, the blades are capable of readily bending in response to insertion and removal of a sign from the holder.

The three blade, pressure pad arrangement provides for ease of insertion, removal and maintenance of the sign in the holder.

Referring now to FIG. 4, there is shown the holder 10 in which a sign 54 has been inserted. The sign 54 is typically a planar sheet of rigid material such as plastic or metal. The sign 54 is inserted into the holder 10 such that the lower edge 56 of the sign lies in the trough 42 in abutment with the bottom edge thereof. The abutment of the sign with the trough bottom establishes the vertical position of the sign.

To insert the sign in the holder, a downward force is applied to the sign sufficient to overcome any resistance provided by the blades 48, 50 and 52. By virtue of the resiliency of the blades of pressure pad 44, a force is exerted by the blades on the sign in a direction to urge the sign 54 flush against the wall 36. The force results from the displacement of the blades from the surface of wall 36 by the sign. As a result of insertion of the sign into the holder, blades 48, 50 and 52 are bent downward (as shown in FIG. 4).

In addition to providing a seat for the sign edge 56, the trough 42 prevents rotation of the sign out of the holder as a result of corresponding forces on the sign such as caused, for example, by strong winds. As viewed in FIG. 4, rotation of the sign out of the holder in a clockwise manner about the pressure pad blades 48, 50 and 52 is prevented by virtue of the interference of the sign edge 56 with the wall 36. Similarly, rotation of the sign in a counterclockwise manner about the pressure pad blades is prevented by virtue of the interference of the sign edge 56 with the lower extremity of wall 38.

Advantageously, the V-shaped trough 42 provides for seating signs that have different thicknesses. Thus, a "thin" (measured between sign faces) sign would seat lower in the trough than a "thick" sign.

While the basic principle of this invention has been herein illustrated along with one embodiment, it will be appreciated by those skilled in the art that variations in the disclosed arrangement both as to its details and as to the organization of such details may be made without departing from the spirit and scope thereof. Accordingly, it is intended that the foregoing disclosure and the showings made in the drawings will be considered only as illustrative of the principles of the invention and not construed in a limiting sense.

What is claimed is:

1. A holder for an essentially thin rigid planar sign, the holder comprising:

a base;

first and second rigid walls formed in the base;

a V-shaped groove defined by the first and second walls within the base, the groove being adapted for receiving an edge of the sign; and resilient blade means mounted in the base, the blade means oriented for urging a sign inserted in the V-shaped groove against the first wall, the V-shaped groove restraining an edge of the sign so that the sign is prevented from rotation away from the wall;

the first and second walls being characterized in that they define a fixed angle therebetween during insertion and removal of the sign, the blade means being characterized in that there is a deformation thereof during insertion and removal of the sign to facilitate ease of insertion and removal.

2. The holder of claim 1 wherein the groove has an extension along a substantially straight line, and wherein the blade means comprises a resilient member having a base portion and a plurality of spaced apart blades extending from the base portion, each blade extending along an axis lying in a plane substantially normal to the first wall, the plane in which the axis lies being parallel to the extension of said groove, each blade having a tip that terminates adjacent the surface of the first wall.

3. The holder of claim 2 wherein said plurality of blades comprises three blades.

4. The holder of claim 3 wherein the base comprises means for securing said base to a support surface separate from the holder.

5. The holder of claim 4 wherein the securing means comprises a pair of extensions lying in a plane substantially normal to the wall, the extensions having means for adhesively mounting said extensions to such support surface.

6. The holder of claim 3 wherein the base comprises a pair of inclined flat surfaces facing away from each other in substantially opposite directions for mounting thereon respective sides of a sign having a triangular cross section.

7. The holder of claim 6 comprising means for securing respective sides of such sign to the inclined flat surfaces.

8. A holder for planar signs comprising:

a base;

first and second spaced apart walls located in the base;

an inclined wall in the base interconnecting said spaced apart walls, the inclined wall being inclined with respect to the first wall and forming thereby a trough between the first wall and the inclined wall, the trough adapted for seating an edge of a sign; and resilient means extending from said second wall for urging a sign inserted in the holder against the first wall, the resilient means being characterized in that it deforms during insertion and removal of the sign to facilitate ease of insertion and removal of the sign, the first, second and inclined walls being characterized in that they remain in fixed relative position during insertion and removal of the sign.

9. A holder according to claim 8 wherein said base includes means for securing said resilient base portion therein, comprising a dovetail joint between the resilient pressure member and the backing for securing the pressure member to the backing.

10. The holder of claim 1 wherein the plane of first is parallel to the plane of the sign to be inserted.

11. A holder according to claim 1 wherein the resilient blade means has an external surface which is sinusoidal and faces the first wall.

12. A holder for a thin, rigid substantially planar panel, the holder comprising:

a base including a first side adapted for mounting the holder to a separate surface;

a second side having a V-shaped groove with an opening extending therein for receipt of such planar panel;

a substantially rigid planar wall along a first side of said groove;

a resilient pressure member on a second side of said groove including at least three spaced apart resilient blades positioned at differing distances from the opening of the groove to press the panel against said wall, the blades being characterized in that there is a deformation thereof during insertion and removal of the sign to facilitate insertion and removal, the resilient pressure member including an elongated resilient base portion from which said blades extend toward said wall; and means for securing the resilient pressure member on said second side of said groove comprising a dovetail joint.

* * * * *

UNITED STATES PATENT AND TRADEMARK OFFICE

CERTIFICATE OF CORRECTION

PATENT NO. : 4,387,520

DATED : June 14, 1983

INVENTOR(S) : James E. Ahrens

It is certified that error appears in the above-identified patent and that said Letters Patent is hereby corrected as shown below:

Column 6, line 42, Claim 10, should read

-- The holder of claim 1 wherein the plane of the first wall is --.

Signed and Sealed this

First Day of November 1983

[SEAL]

*Attest:*

GERALD J. MOSSINGHOFF

*Attesting Officer*

*Commissioner of Patents and Trademarks*